United States Patent [19]

Hoffman

[11] Patent Number: 4,742,292

[45] Date of Patent: May 3, 1988

[54] CMOS PRECISION VOLTAGE REFERENCE GENERATOR

[75] Inventor: Charles R. Hoffman, Raleigh, N.C.

[73] Assignee: International Business Machines Corp., Armonk, N.Y.

[21] Appl. No.: 23,189

[22] Filed: Mar. 6, 1987

[51] Int. Cl.[4] ..... G05F 3/22

[52] U.S. Cl. ..... 323/314; 323/907

[58] Field of Search ..... 323/313, 314, 315, 316, 323/317, 907; 330/257, 261, 288, 296; 307/296 R, 297, 304

[56] References Cited

U.S. PATENT DOCUMENTS 3,975,648 8/1976 Tobey, Jr. et al. ..... 323/314 X 4,622,480 11/1986 Uchimura et al. ..... 330/261

*Primary Examiner*—Peter S. Wong

*Attorney, Agent, or Firm*—Joscelyn G. Cockburn

[57] ABSTRACT

A differential voltage, set by threshold differences of a natural FET and an implanted FET, is amplified by a switched capacitor amplifier and filtered by a filtering circuit to provide an accurate reference voltage that is independent of temperature, process variation and power supply voltage changes.

9 Claims, 3 Drawing Sheets

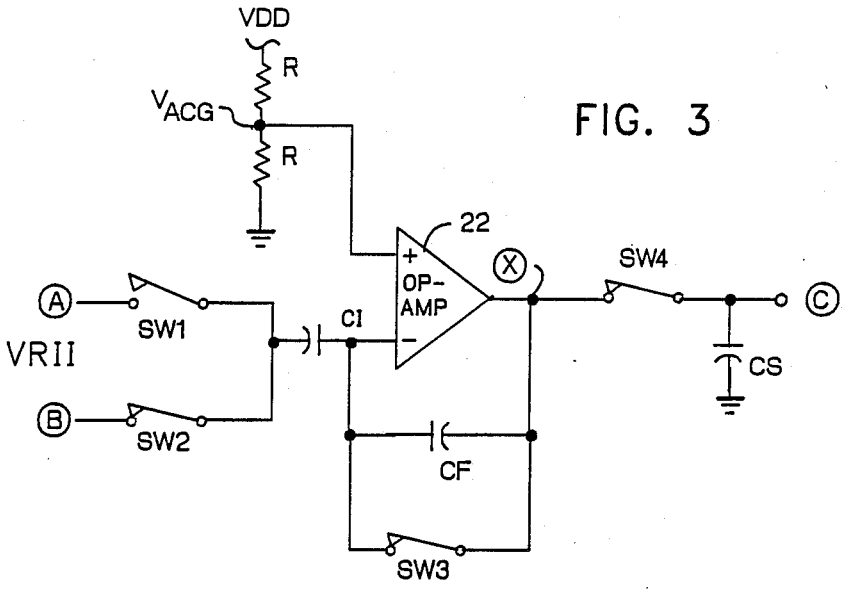
FIG. 3
FIG. 4
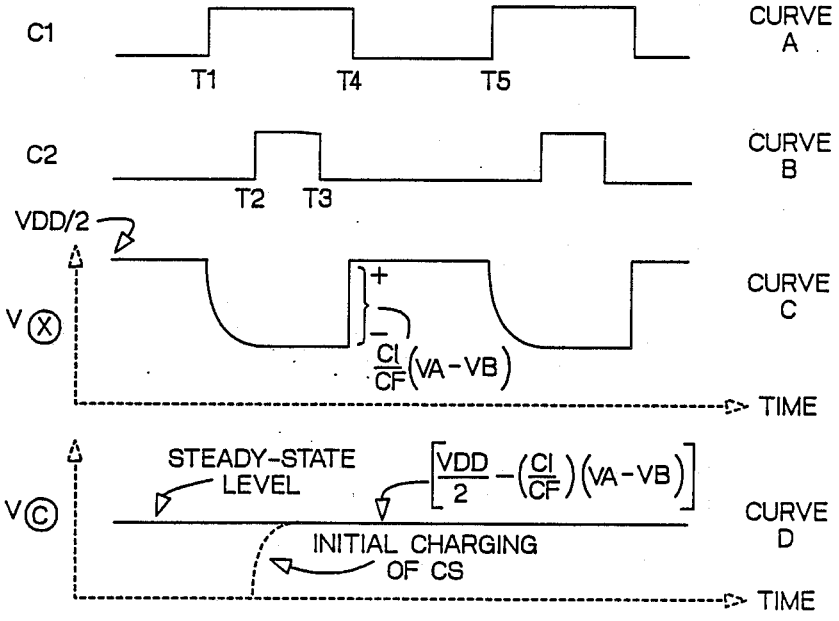

CMOS PRECISION VOLTAGE REFERENCE GENERATOR

BACKGROUND OF THE INVENTION

1. Field of the Invention

This invention relates to integrated circuit technology in general, and more particularly, to circuits that generate reference voltage in said technology.

2. Prior Art

Rapid improvements in the development of integrated circuit technology have made it possible for analog and digital circuits to be combined on the same chip. In the past, separate integrated circuit modules were used to package analog and digital circuits, respectively. With separate packaging, one would select a process that optimizes the fabrication of a particular circuit type. However, by combining the two types of circuits on a single chip, it becomes necessary to select a process that at least optimizes the fabrication of the circuits that dominate the chip.

In addition, each type of circuit usually requires unique functions that may not be needed by the other type of circuit. Thus, it is desirable to use a process that optimizes the implementation of these functions.

It has been determined that a "digital CMOS process" is effective in the implementation of mixed circuit (i.e., digital and analog) integrated chips. Usually, the analog circuits in CMOS are a small part of a predominantly digital circuit chip. Thus, the "digital CMOS process" optimizes the implementation of devices that are needed to implement the digital portion of the chip. Devices that are needed to implement analog functions are not available. Thus, a circuit designer is faced with the awesome task of using digitally friendly devices to implement analog functions. Among the many analog functions which a designer must provide is a stable reference voltage.

The generation of a reference voltage using CMOS technology has been done in the past. Known prior art implementation uses two FETs with different threshold voltages. The differential voltage resulting from the different thresholds is the reference voltage. The prior art also teaches that the device threshold voltages can be controlled by ion implantation and different device geometrics. Examples of the prior art teachings are set forth in U.S. Pat. Nos. 4,442,398; 4,305,011; 4,464,588; 4,100,437; 4,327,320; 4,472,871 and 4,453,094.

Even though the prior approach is a step in the right direction it suffers from several defects which the present invention will address and correct. Except for U.S. Pat. No. 4,305,011, the prior art patents do not teach how to convert the differential voltage to a single ended voltage. For most applications, the differential voltage has to be converted to a single-ended voltage before it can be used.

Although U.S. Pat. No. 4,305,011 converts the differential voltage to a single-ended voltage, the magnitude of the single-ended voltage cannot be adjusted. In other words, the single-ended voltage has the same magnitude as the differential voltage. Another problem which is evident in the conversion technique is that switching transients and unwanted clockfeed through signals are present in the single-ended voltage signal.

Other publications addressing CMOS reference voltage generators are:

1. Gray, P. R. and Meyer, R. G., "Analysis and Design of Analog Integrated Circuits," 2nd edition, Wiley, N.Y., 1983, Chapter 12.

2. Blauschild, R. A., et al, "A New NMOS Temperature-Stable Voltage Reference," IEEE JSSC, December, 1978, pp. 767–773.

3. Song, B. S. and Gray, P. R., "A Precision Curvature-Connected CMOS Bandgap Reference," Digest of Papers, 1983, ISSCC.

4. Liu, S., and Nagel, L. W., "Small-Signal MOSFET Models for Analog Circuit Design," IEEE JSSC, December, 1982, pp. 983–998.

5. Gregorian, R. et al, "Switched-Capacitor Circuit Design," IEEE Proceedings, August, 1983, pp. 941–966.

A common problem faced by these designs is that there is a wide variation in the range of threshold voltages. It is believed that the wide variation in threshold voltages is caused by variation in the process used to fabricate the chip. Another common problem is that non-CMOS structures such as bipolar structures are fabricated in the LSI chip. This requires additional process steps which increase the cost of the chip.

BRIEF SUMMARY OF THE INVENTION

It is therefore the primary object of the present invention to provide a CMOS circuit arrangement which establishes an accurate single-ended voltage level that is independent of temperature, power supply voltage, and is minimally affected by process variations.

It is another object of the present invention to drive the CMOS circuit arrangement with a positive power supply.

The circuit arrangement is comprised of a reference voltage generator formed from two enhancement FETs. One of the enhancement FETs has a natural (i.e., unaltered) threshold and the other FET has an altered threshold. The generator provides a double-ended differential voltage signal which is scaled by a switched capacitor amplifier circuit arrangement and is filtered by a supply dependent circuitry to provide an accurate single-ended reference voltage.

The foregoing features and advantages of this invention will be more fully described in the accompanying drawings.

BRIEF DESCRIPTION OF THE DRAWINGS

FIG. 3 shows a circuit schematic for a switched capacitor amplifier.

Fig. 4 shows clock pulses which control the amplifier of FIG. 3 and pulses generated by the amplifier.

DETAILED DESCRIPTION OF THE PREFERRED EMBODIMENT

Figure 1:
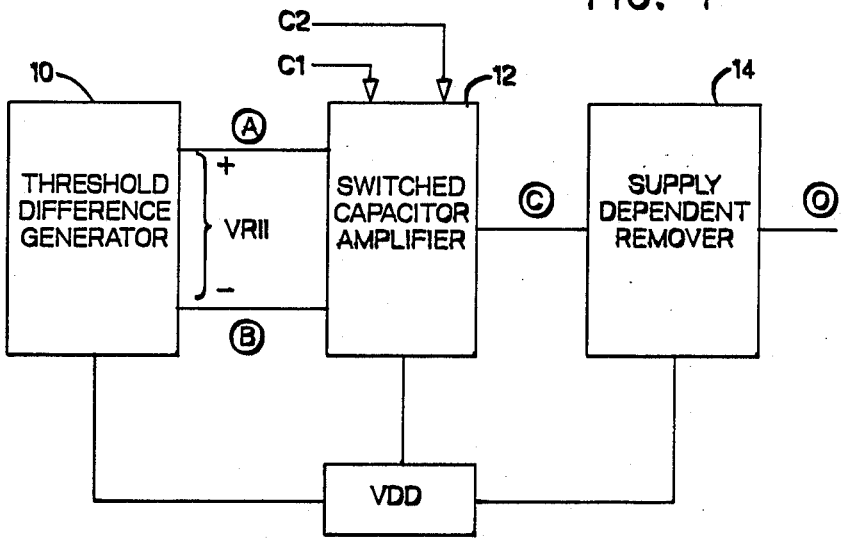
FIG. 1 shows a block diagram of the voltage reference generator circuit according to the teachings of the present invention.

FIG. 1 shows a block diagram of the voltage reference generator circuit according to the teachings of the present invention. The voltage reference generator circuit includes a threshold difference generator 10, a switched capacitor amplifier 12 and a supply dependent remover 14. The threshold difference generator 10 provides a differential voltage $V_{RII}$ at nodes A and B, respectively. As will be explained subsequently, the differential voltage at node A and node B is a fixed value set by threshold tailoring implant. The fixed differential voltage ($V_{RII}$) is amplified by switched capacitor amplifier 12 and appears at node C as a voltage level proportional to the amplified $V_{RII}$. Clocks C1 and C2 are used to switch capacitors (to be described hereinafter) in the switched capacitor amplifier. As will be explained subsequently, the voltage at node C is dependent on the power supply voltage, $V_{DD}$. This dependency is removed by the supply dependent remover 14, leaving a voltage that is dependent only on $V_{RII}$ and component matching characteristics.

Figure 2:
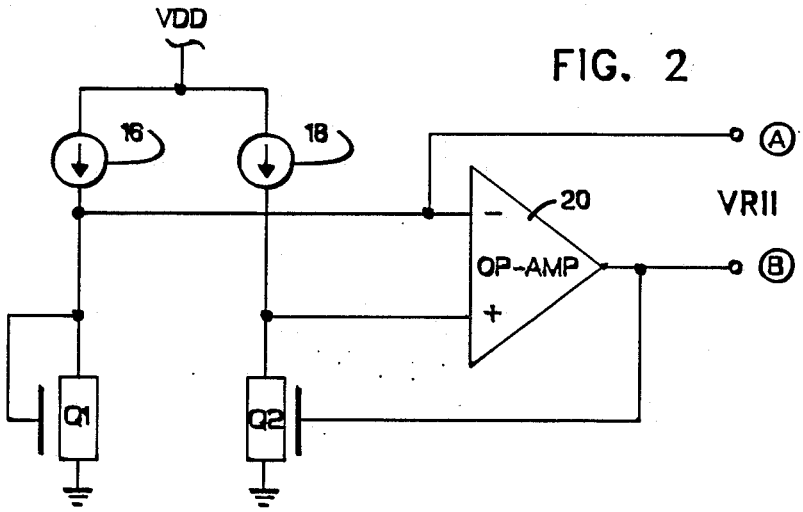
FIG. 2 shows a circuit schematic for a threshold difference generator.

FIG. 2 shows a circuit schematic of the threshold difference generator. The threshold difference generator is comprised of a pair of N-channel enhancement mode FET devices Q1 and Q2, a matched pair of current sources 16 and 18 and operational amplifier (op amp) 20. FET device Q1 is connected in series with current source 16. Likewise, FET device Q2 is connected in series with current source 18. The current sources 16 and 18 are connected to the power supply $V_{DD}$. The gate electrode of FET device Q1 is connected to the drain electrode and the drain electrode is connected to the inverting input of operational amplifier 20. Likewise, the drain of FET device Q2 is connected to the positive input of amp 20. The differential voltage $V_{RII}$ which appears at nodes A and B, respectively, is formed by the difference in threshold between transistors Q1 and Q2, respectively. To provide this difference in threshold voltages, the threshold voltage of Q1 is maintained at its natural level while the final threshold voltage of device Q2 is tailored so that digital circuit performance is optimized. As is used in this document, "natural threshold" means the threshold voltage existing before a device is subjected to a threshold tailoring implant process. The threshold tailoring is a process step in which ions are implanted to shift the threshold voltage of a device. It should be noted that the threshold shift could have been implemented on Q1 rather than Q2. In other words, the threshold tailoring implant may be practiced on either Q1 or Q2.

Still referring to FIG. 2, it can be proven mathematically that the voltage difference between nodes A and B is the threshold difference between the natural FET device and the implanted FET device. This is done by writing a set of current equations for Q1 and Q2 and solving them. To write these equations it is assumed that this circuit operates so that Q1 and Q2 are operating in their respective saturation regions and, therefore, their current can be written as:

$$I_{ds}=(B_o/2)(V_{GS}-V_T)^2(1+\lambda V_{ds}) \quad (1)$$

where:

$I_{DS}$=drain-to-source current
$V_{GS}$=gate-to-source voltage
$V_T$=device threshold voltage
$V_{DS}$=drain-to-source voltage
$\lambda$=channel-shortening coefficient
$B_o=(\mu s\ K_{ox}E_oT_{ox})\ (W/L)$
$\mu s$=surface mobility
$K_{ox}$=relative dialectic constant of gate oxide
$E_o$=permitivity in free space
$T_{ox}$=gate oxide thickness
W=channel width
L=channel length When this equation is used for Q1 and Q2 assuming that the W/L ratio is the same for both transistors and that the operational amplifier has sufficient gain to make the drain voltages of the two FETs equal, we get:

$$I_1=(B_o/2)(V_A-V_{TLO}-V_{RII})^2(1+\lambda V_A) \quad (2)$$

$$I_2=(B_o/2)(V_B-V_{TLO})^2(1+\lambda V) \quad (3)$$

where $I_1$ and $I_2$ represent current flowing through Q1 and Q2, respectively. Since $I_1=I_2=I$, we can set the right side of (2) and (3) equal getting:

$$V_A-V_B=V_{RII} \quad (4)$$

It should be noted that I represents the current in current sources 16 and 18, respectively.

FIG. 3 shows a circuit diagram for the switched capacitor amplifier 12 (FIG. 1.). The switched capacitor amplifier is comprised of operational amplifier 22. The differential voltage $V_{RII}$ (FIG. 2) is coupled via switches SW1 and SW2, and capacitor $C_I$ to the negative terminal of the operational amplifier. As will be described subsequently, switch SW1 is driven by clock pulses C1 (FIG. 4) while switch SW2 is driven by the negative phase of clock C1. A voltage divider circuit formed from identical series connected resistors R is connected to $V_{DD}$ and form a bias voltage at node $V_{ACG}$. As will be explained subsequently, node $V_{ACG}$ is effectively an A.C. ground at voltage level $V_{DD}/2$. The output of operational amplifier 22 is tied to node X and a feedback circuit comprising of capacitor $C_f$ and switch $SW_3$ interconnects node X of the operational amplifier to the negative input terminal. Likewise, switch SW4 interconnects node X to capacitor $C_s$ and output node C.

FIG. 4 shows a graphical representation of clock pulses that are used for driving the switches in FIG. 3 and voltage waveforms that are generated at selected nodes of FIG. 3. In particular, curve A is a representation of clock C1 which is used for driving switch SW1 (FIG. 3). Likewise, curve B represents clock C2 which is used for driving switch SW4 (FIG. 3). Curve C is a graphical representation of the voltage waveform which is outputted at node X (FIG. 3). Finally, curve D shows a graphical representation of the steady state level voltage signal which is outputted at node C (FIG. 3).

Usually, only two voltage levels ($V_{DD}$ and ground) are available in a digital process such as CMOS. In order for the circuit of FIG. 3 to provide proper amplification, operational amplifier 22 must operate in its linear region. The linearity is assured by biasing the non-inverting input of the operational amplifier between the $V_{DD}$ and ground levels. This effectively creates an A.C. ground ($V_{ACG}$) at the voltage level $V_{DD}/2$. The output of the amplifier (node X, FIG. 3) is then an amplified input of ($V_A-V_B$) riding on the A.C. ground voltage. A graphical representation of this phenomenon is shown in curve C (FIG. 4).

Still referring to FIGS. 3 and 4, capacitors CI and CF must be periodically reset. The resetting procedure is necessary to prevent charge loss due to leakage on capacitors CI and CF, respectively. This is done using CI by closing switch SW3. With switch SW3 closed, CF is shorted, causing node X and the inverting input to operational amplifier 22 to be set at $V_{ACG}$. Simultaneously, the voltage at node B is connected to the left plate of capacitor CI via SW2. During the C1 time, switch SW3 and switch SW2 are opened while switch SW1 is closed. The voltage on node A is transferred to the left plate of capacitor C1. The difference between $V_A$ and $V_B$ causes a charge flow in capacitor CF and a resulting output voltage change from $V_{ACG}$ of:

$$\Delta V_{out}=(CI/CF)(V_A-V_B) \quad (5)$$

A graphical representation of $\Delta V_{out}$ is shown in curve C (FIG. 4). Because there is a finite time for node X (FIG. 3) to settle to its final value, the C2 clock is delayed for a period (T2−T1) before turning on. This ensures that the node C voltage is free of glitches. The voltage at node C is shown in curve D (FIG. 4). The voltage may also be described by the following mathematical expression:

$$V_c=V_{DD}/2-(CI/CF)(V_A-V_B) \quad (6)$$

Substituting (4) above for $(V_A-V_B)$ gives:

$$V_C=V_{DD}/2-(CI/CF)V_{RII} \quad (7)$$

From (7) it is seen that $V_C$ is $V_{DD}$ dependent. This dependency is removed with the circuit of FIG. 5.

Figure 5:
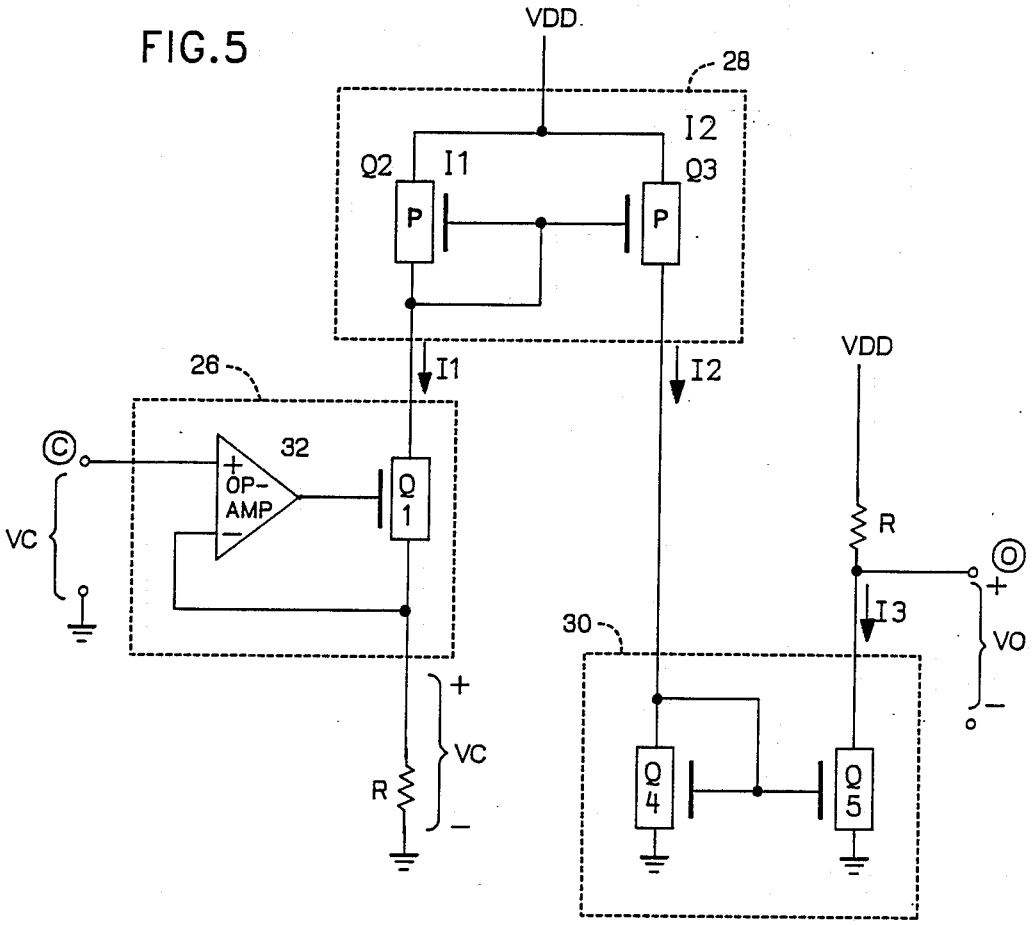
FIG. 5 shows a circuit schematic of the supply dependent remover.

FIG. 5 shows a circuit for removing the $V_{DD}$ component of the output signal. The circuit is comprised of voltage follower network 26, current mirror network 28 and current mirror network 30.

The voltage follower network 26 includes op amplifier 32 and N-channel FET device Q1. The gate of Q1 is connected to the output of op amplifier 32. The source of Q1 is tied to the inverting input of op amplifier 32 and to ground via resistor R. The configuration ensures that an input voltage $V_c$ appearing at node C is reflected across resistor R.

Still referring to FIG. 5, the drain electrode of FET device Q1 is tied to current mirror network 28. Current mirror network 28 includes P-channel FETs Q2 and Q3. The source electrodes of Q2 and Q3 are tied to supply voltage ($V_{DD}$). The current mirror has a gain of two. Other gain ratios may be used without departing from the spirit and scope of the present invention. The gain is achieved by making the width to length (W/L) ratio of Q3 twice the width to length ratio of Q2. Thus, the current ($I_1$) flowing in Q2 is one-half the current $I_2$ flowing in Q3. The source drain electrode of Q3 is tied to current mirror network 30. Current mirror network 30 includes N-channel FETs Q4 and Q5. The source electrodes of Q4 and Q5 are tied to ground. The drain electrode of Q5 is coupled through resistor R to supply voltage $V_{DD}$ and output voltage $V_o$. Current mirror 30 has a gain of 1. This is achieved by making the width to length ratio of FET devices Q4 and Q5 identical.

The fact that the circuit of FIG. 5 removes the $V_{DD}$ component of the output voltage $V_o$ can be shown mathematically. With reference to FIG. 5, the input voltage ($V_c$) is reflected at the source electrode of FET Q1. Thus, the current ($I_1$) is given by:

$$I_1=V_c/R \quad (8)$$

because the W/L ratio of Q3 is twice that of Q2.

$$I_2=2I_1=2V_c/R \quad (9)$$

Transistors Q4 and Q5 form a current mirror made of N-channel FETs such that:

$$I_3=I_2=2V_c/R \quad (10)$$

The output voltage is:

$$V_o=V_{DD}-I_3=V_{DD}-2V_c$$

$$V_o=V_{DD}-2(V_{DD}/2-(CI)/CFV_{RII}) \quad (11)$$

$$V_o=2CI/CFV_{RII} \quad (12)$$

Thus, it is shown that $V_o$ is dependent only upon the capacitors ratio and a threshold tailoring implant. These variables can be tightly controlled within the CMOS process.

It is worthwhile noting that best current matching is achieved when the drain voltages of the current mirrors are approximately the same. For example, best matching for I2 and I3 occurs when the drain to source voltage ($V_{ds4}$) of Q4=$V_o$. Cascade stages can also be used to increase the output impedance of the current mirrors.

Although a preferred embodiment of the present invention has been described and disclosed in detail, other modifications and embodiments thereof which would be apparent to one having ordinary skills are intended to be covered by the spirit and scope of the appended claims.

I claim:

1. A reference voltage generator circuit for implementation in CMOS technology, said circuit comprising:
   - a first means for generating a differential voltage;
   - a second means for amplifying and shifting the differential voltage to provide a single ended voltage; and
   - a third means for selectively removing unwanted components from said single ended voltage and to provide a reference voltage that is supply and temperature independent; said third means including a voltage follower network having an input node and an output node, a first and a second current mirror networks connected in series to the voltage follower network wherein the gain of the current mirrors is 2 and 1, respectively.

2. The reference voltage generator of claim 1 further including a power supply operating within a voltage range of 5 volts and ground; said power supply being operable for supplying power to the first, second and third means.

3. The reference voltage generator of claim 1 wherein the first means includes:
   - an operational amplifier having an output node, an inverting input and non-inverting input;
   - a first biasing network coupling the output node and the non-inverting input to a first and a second voltage levels; and
   - a second biasing network coupling the inverting input to the first and the second voltage levels whereby the first and second biasing networks are being connected in a parallel configuration with each network having a current source connected in series with an FET device.

4. The reference voltage generator set forth in claim 3 wherein current sources of the first network and the second network are identical and threshold voltages of FET devices of the first network and the second network are different.

5. The reference voltage generator of claim 1 wherein the second means includes an operational amplifier having an inverting input, a non-inverting input and an output node;

a first storage means connected to the inverting input;

a first switching means connected to said first storage means;

a biasing network interconnecting the non-inverting input between a first and a second voltage level;

a feedback network interconnecting the output node to the inverting input;

a second switch means connected in series with the output node; and a second storage means interconnecting the second switch means between a third and a fourth voltage level.

6. The reference voltage generator set forth in claim 5 wherein the biasing network includes identical series connected resistor.

7. The reference voltage generator set forth in claims 5 or 6 wherein the feedback network includes a capacitor connected in parallel with a switch.

8. A reference voltage generator circuit for implementation in CMOS technology, said circuit comprising:

a first means for generating a differential voltage;

a second means for amplifying and shifting the differential voltage to provide a single ended voltage; and a third means, including a voltage follower network having an input node and an output node, a first current mirror network with a gain of at least two coupled to the output node; and a second current mirror network with a gain of at least one coupling an output of said first current mirror to an output terminal for selectively removing unwanted components from said single ended voltage and to provide a reference voltage that is supply and temperature independent.

9. A reference voltage generator circuit for implementation in CMOS technology, said circuit comprising:

a first means for generating a differential voltage;

a second means for amplifying and shifting the differential voltage to provide a single ended voltage; and a third means for selectively removing signal components caused by variations in power supply tolerances and to provide a reference voltage that is supply and temperature independent;

said third means including a voltage follower network having an input node and an output node, a first and a second current mirror networks connected in series to the voltage follower network wherein the gain of the current mirrors is 2 and 1, respectively.

* * * * *